US006004175A

United States Patent [19]

McCoy

[11] Patent Number: 6,004,175

[45] Date of Patent: Dec. 21, 1999

[54] FLUSH VALVE

[75] Inventor: David F. McCoy, Rosendale, Wis.

[73] Assignee: Brunswick Corporation, Lake Forest, Ill.

[21] Appl. No.: 09/111,555

[22] Filed: Jul. 8, 1998

[51] Int. Cl.[6] ..... B63H 21/10

[52] U.S. Cl. ..... 440/88; 137/100

[58] Field of Search ..... 440/88; 137/100; 134/166 R, 169 A, 167 R

[56] References Cited

U.S. PATENT DOCUMENTS

| | | | |
|---|---|---|---|
| 3,550,612 | 12/1970 | Maxon | 440/88 |
| 4,004,533 | 1/1977 | Woolston | 114/16 E |
| 4,065,325 | 12/1977 | Maloney | 134/167 R |
| 4,341,224 | 7/1982 | Stevens | 128/675 |
| 4,359,063 | 11/1982 | Carlson | 134/167 R |
| 4,540,009 | 9/1985 | Karls | 134/167 R |
| 4,589,851 | 5/1986 | Karls | 440/88 |
| 5,010,836 | 4/1991 | Riviezzo | 114/255 |
| 5,123,369 | 6/1992 | Gross | 114/183 R |
| 5,251,670 | 10/1993 | Bates | 137/625.46 |
| 5,362,266 | 11/1994 | Brogdon | 440/88 |
| 5,393,252 | 2/1995 | Brogdon | 440/88 |
| 5,551,479 | 9/1996 | Graves | 137/614.2 |
| 5,671,906 | 9/1997 | Rosen | 251/148 |

*Primary Examiner*—Ed Swinehart
*Attorney, Agent, or Firm*—William D. Lanyi

[57] ABSTRACT

A flush valve is provided which used only one moving component. A ball is used to seal either a first or second inlet when the other inlet is used to cause water to flow through the valve. The valve allows fresh water to be introduced into a second inlet in order to remove residue and debris from the cooling system from the marine propulsion engine. When fresh water is introduced into a second inlet, the ball seals the first inlet and causes the fresh water to flow through the engine cooling system. When in normal use, water flows through the first inlet and seals the second inlet by causing the ball to move against a ball seat at the second inlet. Optionally, a stationary sealing device can be provided within the second inlet and a bypass channel can be provided to allow water to flow past the ball when the ball is moved against the ball seat at the first inlet. This minimal flow of water is provided to allow lubrication for the sea water pump impeller if the sea water pump is operated during the flushing operation in contradiction to recommended procedure.

11 Claims, 5 Drawing Sheets

FLUSH VALVE

BACKGROUND OF THE INVENTION

1. Field of the Invention

The present invention relates generally to a flush valve and, more particularly, to a valve that allows an internal combustion engine cooling system to be flushed by providing an external source of fresh water and connecting the external water source to the valve which is connected in fluid communication with the cooling system of the internal combustion engine.

2. Description of the Prior Art

In certain applications, it is necessary to periodically flush the cooling system of an internal combustion engine. In particular, when an internal combustion engine is used as a power source or a marine propulsion system, such as a stern drive, inboard system, or outboard motor, the marine propulsion system typically uses cooling water taken from the body of water in which the marine propulsion system is used. If the body of water contains salt water and is caused to flow within the cooling passages of the engine, a residue can be deposited on the internal surfaces of the engine. This sea water residue can eventually clog certain passages. In addition, the sea water residue can provide a corrosive atmosphere which can severely damage certain metals. It is therefore advisable to periodically flush the cooling system of the engine with fresh water in order to clean the surfaces of the cooling system and remove the sea water residue and debris. Many different techniques have been developed for flushing the cooling system of marine engines used in salt water applications.

U.S. Pat. No. 5,671,906, which issued to Rosen on Sep. 30, 1997, discloses a flush valve for a water cooled marine outboard engine having a flush orifice. The flush valve includes a valve body with an engine attachment end and a flush water source end. The valve body has a channel between the engine end and the source end. The engine end of the valve body can be affixed into the flush orifice of the engine. The flush valve also includes a means for obstructing a discharge flow of cooling liquid from the engine end of the hollow valve body.

U.S. Pat. No. 5,123,369, which issued to Gross on Jun. 23, 1992, discloses a marine valve structure. The valve apparatus is intended for use with a marine vessel. It has a housing with first, second, and third ports and a valve member within the housing. The housing is mounted to the hull of the vessel with the first port communicating with the body of water outside the vessel. The third port is connected to the cooling system of an engine in the vessel and the second is closed by a quick release plug. The valve member is moveable to open and close communication with the outside. During normal operation, water is drawn through the structure into the engine cooling system and is discharged overboard. In an emergency, the plug can be removed and the valve member moved to a 90° position in which the communication with the outside is closed, allowing the engine to draw water from within the hull and discharge it overboard. The structure can also be used with a service adapter for engine flushing and other maintenance.

U.S. Pat. No. 5,251,670, which issued to Bates on Oct. 12, 1993, discloses a flush valve. The valve is used for alternately supplying fresh water or sea water coolant to marine engines. Such valve, used in combination with marine engine cooling systems, facilitate the flushing of contaminants. In one embodiment the valve includes a first portion having inlet conduits, a second portion having outlet conduits, and a means for rotatably securing the first and second portions together with minimum gap therebetween. Inlet and outlet portions are alternately positioned in a first, single fluid flow relationship (sea water supply) wherein only a first fluid is directed through outlet conduits, or in a second, multiple fluid flow relationship (flushing operation) wherein both a first and a second fluid are sent to outlet conduits. Also, sealing means is provided between the first and second portions to prevent liquid from escaping through the gap therebetween. In another embodiment, the inlet and outlet portions are stationary and a coupling means situated between the portions is alternately positioned to switch the fluid flow relationship. In yet another embodiment, a coupling means is alternately positioned in a first, dual fluid flow relationship, or in a second, dual fluid flow relationship wherein the fluid delivered to the outlet conduits is reversed. The valves may also be useful in industrial applications.

U.S. Pat. No. 5,010,836, which issued to Riviezzo, on Apr. 20, 1991, describes a live well valve for fishing boats. A leak-tight rotatable plug valve for controlling water flow to and from a fish live well in a fishing boat is described in which the valve body has opposite ends connected with an inlet hose for fresh water intake and a drain hose extending from the live well drain. A pump inlet passage in the valve body intersects the valve flow passage and mounts a pump having its discharge connected with a supply hose leading to the live well. When the valve is open, fresh water can be pumped to fill the live well w hen the pump is active and the live well can be drained when the pump is inactive. When the valve is closed, the pump recirculates water through the drain hose and supply hose to avoid stagnation and provide aeration for the live well.

U.S. Pat. No. 4,004,533, which issued to Woolston, on Jan. 25, 1977, discloses a scuttling valve. The valve assembly permits the automatic scuttling, or sinking, of floatable pressure vessels or other containers and comprises an extensible, spring restrained nozzle containing a spring biased ball seal within a flow passage. Vessel internal pressure extends the nozzle from a retracted position to expose the exterior end of the flow passage. A calibrated restraining spring ring maintains the nozzle retracted and in the extended position during pressure vessel operation. The ball seal is displaced from a nonsealing position against a ball seat to preclude pressure relief through the flow passage. After exhaustion of internal pressure, the bias spring and external water pressure force the ball seal from the ball seat to permit water entry and subsequent sinking of the vessel.

U.S. Pat. No. 4,341,224, which issued to Stevens, on Jul. 27, 1982, discloses a catheter flushing apparatus. The flow control apparatus has a flow passage with an inlet and outlet. It is provided in a housing. A control means having a conical valve seat and ball member for restricting flow through the seat is provided in the inlet of the passage. A valve plunger is slidably located within the housing and is resilently biased against a second valve seat provided in the passage walls of the housing. The plunger includes a marine bore capillary passage which effectively bypasses the second valve seat, thus permitting a first flow. When the plunger is moved from its seat, a second higher flow is established for flushing the device. This second higher flow rate is controlled by valve control means in the inlet of the passage in order to prevent excessively high flow rates.

U.S. Pat. No. 5,393,252, which issued to Brogdon on Feb. 28, 1995, discloses a fresh water flushing system for a marine engine system in a boat. It can be used whether the boat is in or out of the water. The system comprises a control panel mounted in the proximity of the marine engine and a fresh water flush valve. Hoses are connected to the fresh water flush valve and to various components of the marine engine system in order to provide fresh water fluid flow within the engine. Alternative embodiments of the system are described in marine vessels with more than one engine.

U.S. Pat. No. 5,362,266, which issued to Brogdon on Nov. 8, 1994, describes a fresh water flushing system for a marine engine. The system comprises a control panel that is mounted on the interior of the boat, a plurality of tubular "T" shaped interconnection fittings in a raw sea water cooling circuit, and a fresh water flush valve therebetween. The components are connected for fresh water fluid flow with a plurality of standard radiator hoses. The fresh water flush valve has a valve plunger for establishing fresh water flow between the control panel and the "T" shaped interconnection fittings. Furthermore, the fresh water flush valve has a plurality of axial outlet ports to proportionately direct the flow of fresh water to the appropriate interconnection fitting in the raw sea water cooling conduit of the marine engine. A valve plug is provided to secure a positive closure when the fresh water flow is disconnected. The valve plug has a tapered body and an O-ring to effect a positive seal and ensure that no fluid backflow occurs when the flushing system is not in use and the marine engine is operating under normal conditions in sea water. All of the fixed and moveable parts are fabricated from material that resists salt air and salt water corrosion.

U.S. Pat. No. 4,359,063, which issued to Carlson on Nov. 16, 1982, discloses a spring-biased flushing accessory for outboard motors. The self-gripping spring-biased accessory directs water from an outside source in order to flush the cooling system of a marine engine. The accessory comprises a U-shaped retainer which terminates at its ends in a pair of resilient suction cups which are constructed to bear against the cooling water intake ports on opposite walls of the engine housing. At least one of the cups is connected to an external source of flushing water. A particular feature of the invention, which is disclosed in several different embodiments, is that the U-shaped retainer is provided with an auxiliary device to impart a spring-bias to the legs and urge them to move towards one another to secure the suction cups in resilient sealed relation against the cooling water intake ports. In one modification of the invention, a device is provided to apply the flushing water simultaneously to intake ports on opposite sides of the engine housing.

U.S. Pat. No. 4,065,325, which issued to Maloney on Dec. 27, 1977, describes an adaptable flush attachment for marine engines having side cooling ports. The device is a universally adaptable component for use in flushing outboard and inboard/outboard marine engines. This is made possible by the unique design of the strap and the shape of the cups which allow for the device to attach against the motor shaft housing on motors having shaft housings of different dimensions and contours.

U.S. Pat. No. 4,540,009, which issued to Karls on Sep. 10, 1985, discloses a flushing device for an outboard motor. The device supplies water to the cooling water inlets of an outboard motor and uses a connecting pin extending through the inlets to attach a pair of sealing cups over the inlets. A sliding spring latch releasably attaches one of the cups to the connecting pin. A hose connection allows water to be supplied to the inlets through the cups.

U.S. Pat. No. 4,589,851, which issued to Karls on May 20, 1986, describes a flushing device for an outboard motor. The device is provided so that water can be supplied to an inlet which is provided on the bottom of the anti-ventilation plate of an outboard motor. The flushing device uses a mounting bracket to hold a resilient cup compressed in place over the water inlet. A hose connector allows the cup to be connected to a water supply.

It would be beneficial if a flush valve could be provided that allowed a boat operator to simply connect a fresh water source (e.g. a hose) to the valve without having to manipulate the valve in any way prior to flushing the cooling system of the engine with fresh water. It would also be beneficial if a flush valve of this type could be made in such a way that it was not easily clogged with sand or other debris. In addition, it would be beneficial if a flush valve of this type could be manufactured in a way that avoiding the possibility that a valve failure could block the normal flow of cooling water to the engine. Regardless of the precise cause of such a failure, it is necessary to avoid the possibility that a failure of the valve could adversely affect the normal cooling water path for the engine. In other words, a valve of this type should operate in a fail safe manner. It would also be beneficial if a flush valve of the type described above could be manufactured at a relatively low cost and consist of few moveable components. It would also be beneficial to assure that a slight flow of fluid was available to a sea pump impeller in the event that the operator chooses to operate the engine during the flushing procedure.

SUMMARY OF THE INVENTION

A flush valve made in accordance with a preferred embodiment of the present invention comprises a first inlet, a second inlet, and an outlet. The housing structure defines a first fluid path connecting the first inlet in fluid communication with the outlet. The housing structure also defines a second fluid path connecting the second inlet in fluid communication with the outlet. A moveable sealing device is disposed within the housing structure and is responsive to the flow of a fluid along the first fluid path to block the second fluid path. In addition, the moveable sealing device is responsive to the flow of a fluid along a second fluid path to block the first fluid path.

In a particularly preferred embodiment of the present invention, the moveable sealing device is a ball which is moveable into blocking relation with the second inlet in response to flow of a fluid along the first fluid path. The ball is also moveable into blocking relation with the first inlet in response to flow of a fluid along the second fluid path.

In certain embodiments of the present invention, it further comprises a stationary sealing device disposed within the second fluid path which allows the fluid to flow from the second inlet to the outlet, but which inhibits fluid flow from the first inlet to the second inlet.

Certain embodiments of the present invention can also comprise a bypass conduit associated with the first inlet which allows a reduced flow of fluid from the second inlet to pass through the first inlet when the moveable sealing device is blocking the first inlet. In other words, even though the moveable sealing device is moved into blocking relation with the first inlet, a small flow of fluid is intentionally permitted to flow around the moveable sealing device in order to assure a flow of fluid to a pump connected between the present invention and a body of water. This slight flow of fluid is allowed so that the impeller of the pump will not be damaged in the event an operator runs the engine during the flushing procedure with the water inlet openings of the marine propulsion system not disposed in the body of water even though this procedure is not typically recommended. If no fluid is provided to the impeller of the pump when the engine is operated in this manner, damage to the impeller blades can occur unless some water is allowed to flow through the first inlet to the pump when the engine cooling system is being flushed.

A drain opening can be provided in the housing structure of the present invention for draining fluid from the housing structure and the cooling system of the internal combustion engine. The outlet of the flush valve can be connected in fluid communication with the cooling system of an internal combustion engine of a marine propulsion system and the first inlet of the flush valve can be connected in fluid communication with a pump which is configured to pump water from a body of water in which the marine propulsion system is operated. The flush valve can be connected in fluid communication between the pump and the cooling system of the internal combustion engine.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
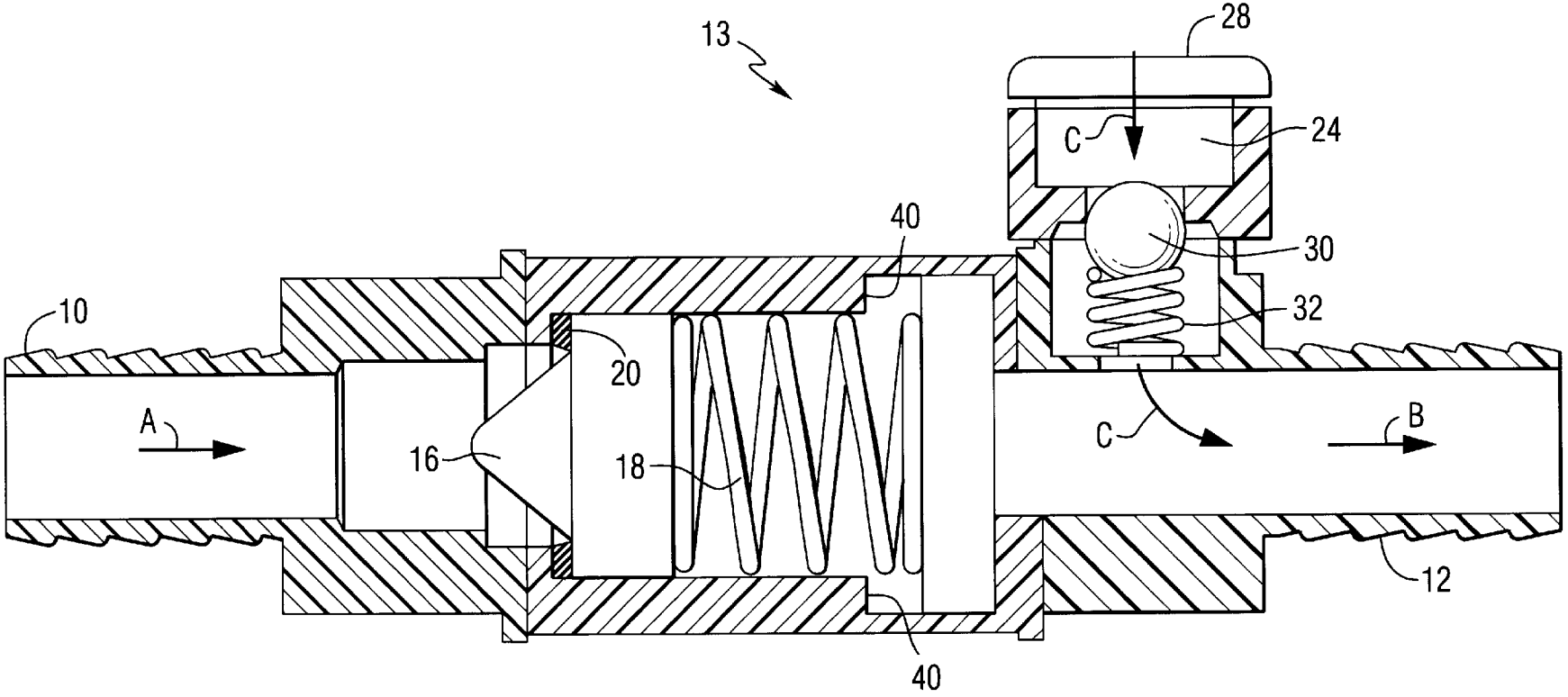
FIG. 1 PRIOR ART
FIG. 1 illustrates a flushing pump known to those skilled in the art.

Throughout the description of the preferred embodiment, like components will be identified by like reference numerals.

FIG. 1 shows a known type of flushing system which is available in commercial quantities from Sherwood, a division of Hypro Corporation. It comprises an inlet IO and an outlet 12. The inlet is typically connected to a sea water pickup port in the hull of the boat. The outlet 12 is typically connected to an inlet of an sea water pump. During normal operation, the stream of water flowing in the direction of arrow A causes a valve plunger 16 to move toward the right in FIG. 1 against the resistance of spring 18. This movement opens a fluid passage between the plunger 16 and a valve seat 20. The water flows through the valve shown in FIG. 1 in the directions represented by arrows A and B, passes through the sea water pump, and is circulated through the engine. The valve shown in FIG. 1 allows the operator to flush the internal combustion engine by introducing fresh water into a secondary inlet 24, as represented by arrows C. The cap 28 is removed and a hose is connected to the secondary inlet 24 to perform the flushing procedure. Water pressure, provided by the fresh water flowing from the hose, forces the ball 30 downward against the resistance of spring 32 and allows a stream of fresh water to flow in the direction represented by arrows C. The fresh water then flows through the sea water pump and the internal combustion engine to clean its internal surfaces.

With continued reference to the valve shown in FIG. 1, it can be seen that the internal structure of the valve includes several individual components which cooperate with each other during its operation. For example, the spring 18 forces the plunger 16 against the valve seat 20. Similarly, the spring 32 holds the ball 30 against its ball seat. The internal construction of the valve in FIG. 1 represents a certain cost of manufacturing and it would be desirable if a valve could be produced which is less expensive and require fewer components. In addition, the valve shown in FIG. I comprises a plurality of ribs 40 which guide the plunger 16 as it moves back and forth against the resistance of the spring 18. It has been determined that the movement of the plunger 16 on the edges of the ribs 40 presents a potential jamming area if sand and debris are ingested, in the direction of arrow A, into the regions of the spring 18. If this debris inhibits the free movement of the plunger 16, two possible deleterious conditions can occur. First, if the plunger 16 is held against its valve seat 20 by the debris, cooling fluid will not easily pass in the directions represented by arrows A and B when the engine is operating. This could possibly cause an engine failure. If, alternatively, debris prevents the plunger 16 from seating against its valve seat 20, fresh water introduced into the secondary inlet could flow out past the plunger 16 and the inlet 10. This fresh water would not pass through the internal combustion engine and perform its intended flushing operation.

As can also be seen in FIG. 1, the valve incorporates two springs within its structure. If spring 18 fails by breaking, the plunger 16 could be free to move back and forth within its chamber and between the ribs 40 even though no water is flowing in the direction represented by arrow A. This could allow water to drain from the engine when this drainage is not desired. In addition, free movement of the plunger 16 without the resistance provided by the spring 18 would allow fresh water to flow from the secondary inlet 24 to the primary inlet 10 and not in the desired direction through outlet 12 during flushing operations.

The known flush valve shown in FIG. 1 is intended to be connected between a sea water pump and an inlet port through the hull of the boat where sea water can be drawn for the purpose of cooling the engine. With the flush valve connected in this position between the sea water intake port and the sea water pump, it would be required that the marine propulsion engine be running during the flushing procedure. Otherwise, it is believed that fresh water introduced into the secondary inlet 24 would not easily flow through the sea water pump unless it is running during the flushing procedure. It would therefore be beneficial if a flush valve could be developed that did not require the sea water pump to be operated during the flushing process.

Figure 2:
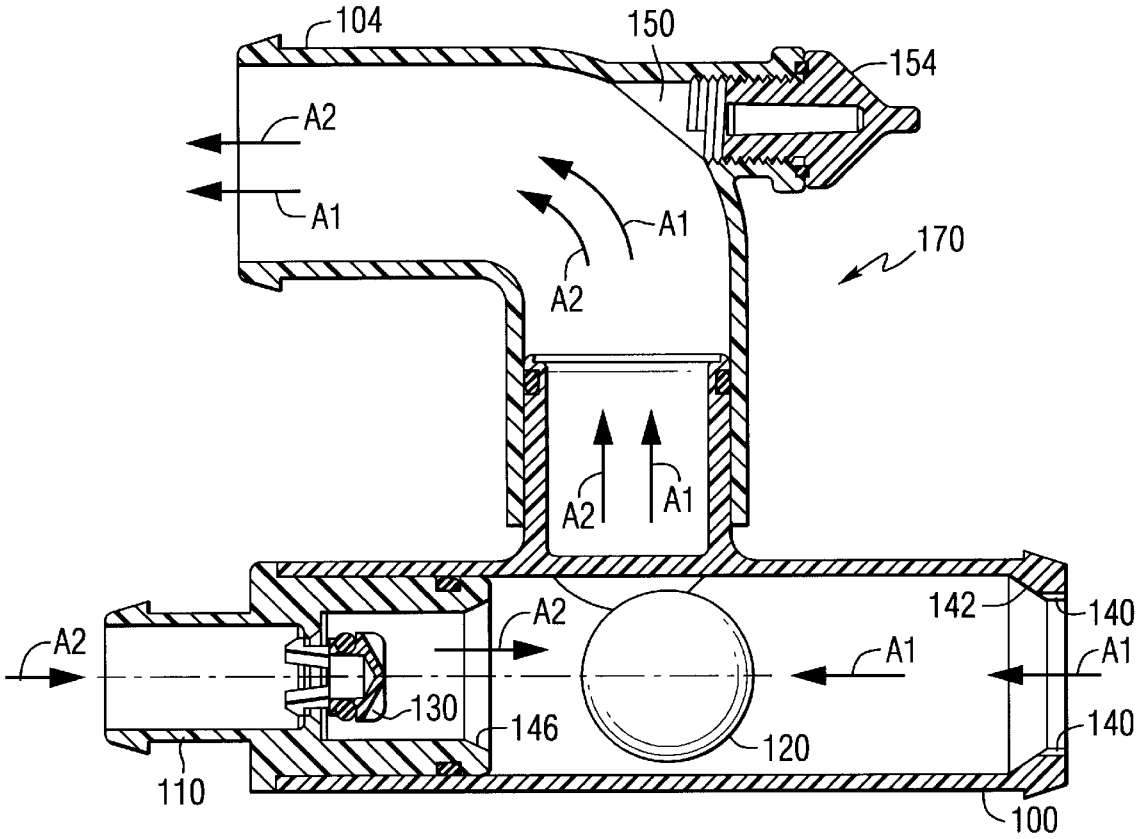
FIG. 2 is a section view of the present invention.

In order to provide a less expensive flush valve than that shown in FIG. 1 and in order to avoid the deleterious results of breakage or internal jamming caused by debris, the present invention provides the simplified flush valve shown in FIG. 2.

The present invention illustrated in FIG. 2 comprises a first inlet 100 and an outlet 104. It also comprises a second inlet 110. The housing structure shown in FIG. 2 defines a first fluid path, defined by arrows A1, and a second fluid path, defined by arrows A2. The first fluid path connects the first inlet 100 in fluid communication with the outlet 104. The second fluid path connects the second inlet 110 in fluid communication with the outlet 104.

The present invention further comprises a moveable sealing device 120 which, in a particular preferred embodiment of the present invention, is a ball. The moveable sealing device 120 is responsive to the flow of a fluid along the first fluid path A1 to block the second fluid path A2 and the moveable sealing device is also responsive to the flow of a fluid along a second fluid path A2 to block the first fluid path A1. A moveable sealing device can be a ball 120, as illustrated in FIG. 2, which is moveable in blocking relation with the second inlet A2 in response to flow of a fluid along the first fluid path A1. In addition, the ball 120 can be moveable into blocking relation with the first inlet 100 in response to flow of the fluid along the second fluid path A2. The response of the ball 120 to these various flows of fluid along the first and second fluid paths will be described in greater detail below.

In a particularly preferred embodiment of the present invention, it further comprises a stationary sealing device 130 which is disposed within the second fluid path A2 and which allows fluid flow from the second inlet 110 to the outlet 104, but inhibits fluid flow from the first inlet 100 to the second inlet 110. In other words, the stationary sealing device 130 only allows fluid to flow through it in the direction represented by arrows A2. It resists flow in the opposite direction.

The present invention also comprises a bypass conduit which, in the embodiment of FIG. 2, is represented by grooves 140 formed in the surface of the ball seat 142. The bypass conduit provides an important function in certain applications of the present invention. When the ball 120 is moved against the ball seat 142 to block flow through the first inlet 100, it is sometimes necessary to is provide a slight flow of fluid through the first inlet 100 in order to provide lubrication to the sea water pump of a marine propulsion system.

Although the present invention is intended to be used to flush a marine propulsion system when the internal combustion engine is not operating, it must be realized that the operator of a marine propulsion system may be tempted to operate the internal combustion engine during the flushing procedure. When this occurs, certain styles of marine propulsion systems provide a sea water pump that is connected with fluid communication between the valve shown in FIG. 2 and the body of water in which the engine is intended to operate. If the marine vessel is removed from the body of water and the flushing procedure is performed with the marine vessel on its trailer and out of the body of water, operation of the sea water pump can possibly cause damage to the impeller of the pump if it is run without water flowing through its internal structure. The bypass conduit, provided by the grooves 140, allows some fresh water to flow in the reverse direction around the ball 120 and out of the first inlet 100 toward the sea water pump. This bypass conduit is not a requirement of the present invention, but is provided for the purpose of preventing serious damage from occurring to the impeller blades of the sea water pump if the present invention is used in a non-recommended, but possible, manner.

With continued reference to FIG. 2, a drain opening 150 is also provided. The drain opening 150 is formed in the housing structure and is provided to permit draining of fluid from the housing structure. By removing the plug 154, an operator can allow fluid to drain from the internal combustion engine. Therefore, the valve in FIG. 2 serves the dual purposes of permitting a flushing procedure to be easily performed and, in addition, permitting the engine to be drained of water from its cooling system.

In a typical application of the present invention, the valve 170 is connected between the sea water pump of the marine propulsion system and the internal combustion engine. The sea water pump is connected in fluid communication with the first inlet 100 and the cooling system of the internal combustion is connected in fluid communication with the outlet 104. The second inlet 1 10 can be connected to a hose which is extended to a position where the operator can conveniently connect an external fresh water supply to the end of the hose.

Figure 3:
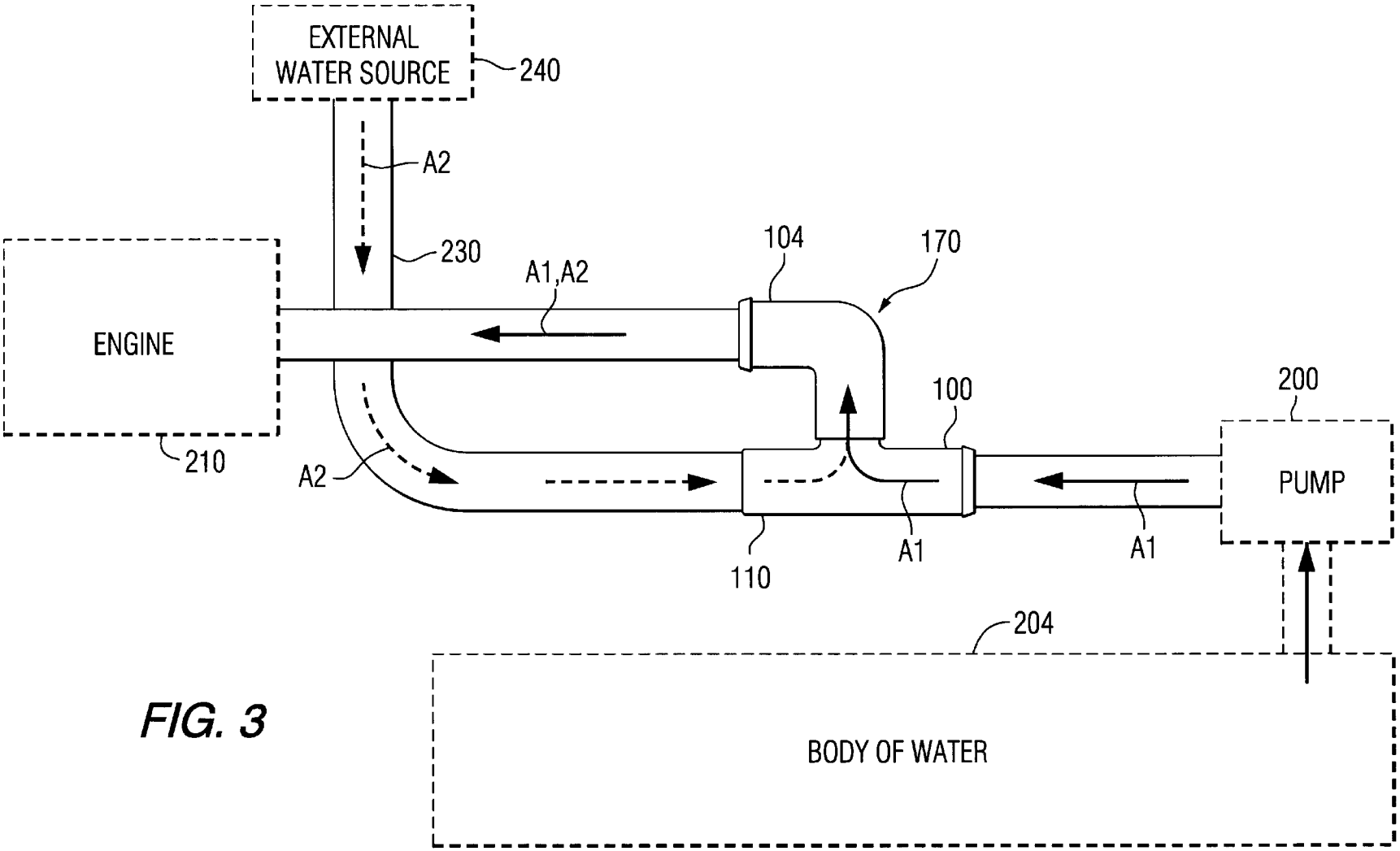
FIG. 3 is a schematic illustration showing the connection of the present invention between a sea water pump and an engine.

FIG. 3 is a highly schematic representation of the valve 170 of the present invention connected within the cooling system of a marine propulsion system. As can be seen, the inlet 100 is connected to a sea water pump 200 which draws water from the body of water 204, which can be a river, lake, or ocean. For normal operation, the sea water pump 200 draws water from the body of water and causes it to flow into the first inlet 100. This water, which can be salt water, then flows through the housing structure of the valve 170 and out of the outlet 104 to the cooling system of an engine 210. After flowing through the engine 210, the cooling water is then typically caused to flow through the exhaust system and back s to the body of water 204 through the exhaust ports of the engine. FIG. 3 also shows the second inlet 110 which is connected to a conduit 230, such as a rubber hose, which can then be connected to an external water source 240. The arrows in FIG. 3 show the first and second fluid paths, A1 and A2.

Figure 4A:
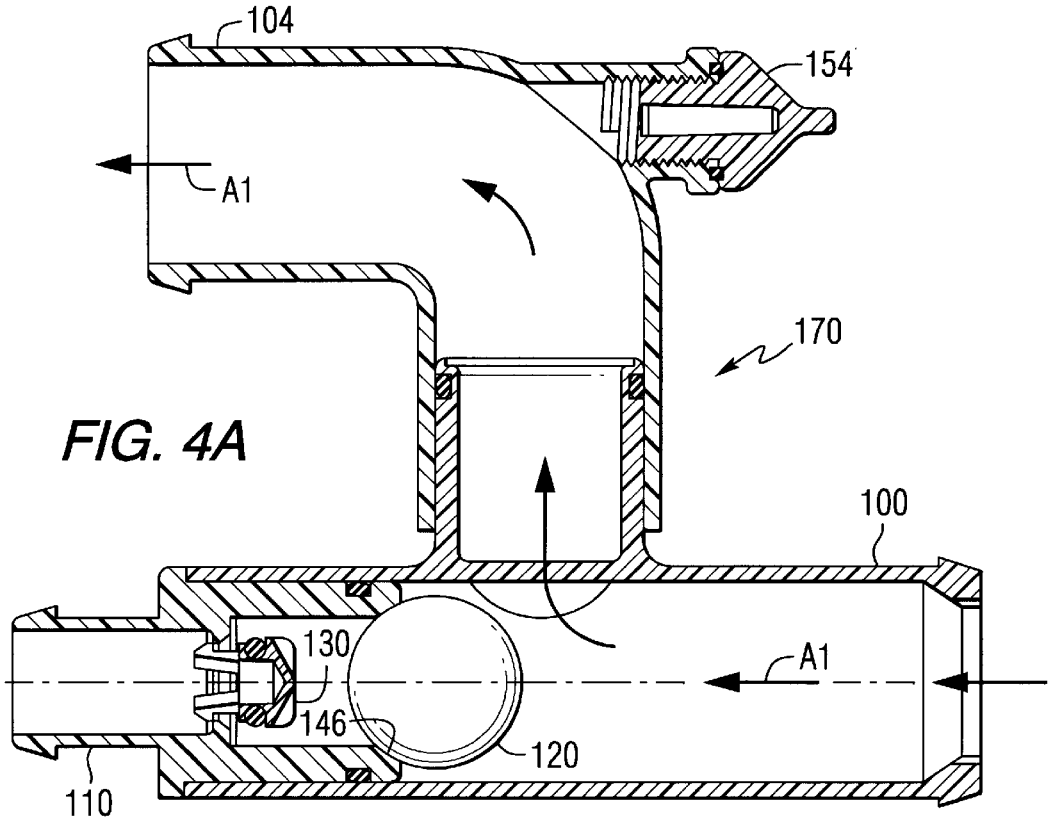
FIGS. 4A and 4B show cross-section views of the present invention under two different conditions of operation.

FIG. 4A shows the internal configuration of the present invention when water flows along fluid path Al from the inlet 100 to the outlet 104. The force of the water causes the ball 120 to move towards the left in FIG. 4A and against the ball seat 146. This prevents water from flowing toward or through the second inlet 110. In embodiments of the present invention which contain a stationary sealing device 130, both the ball 120 seated in the ball seat 146 and the stationary sealing device 130 prevent flow of water out of the second inlet 1 10. The cooling water flows along the first fluid path Al and enters the internal combustion engine to perform its cooling function. FIG. 4A represents the internal configuration of the valve 170 during normal operation of the marine propulsion system.

Figure 4B:
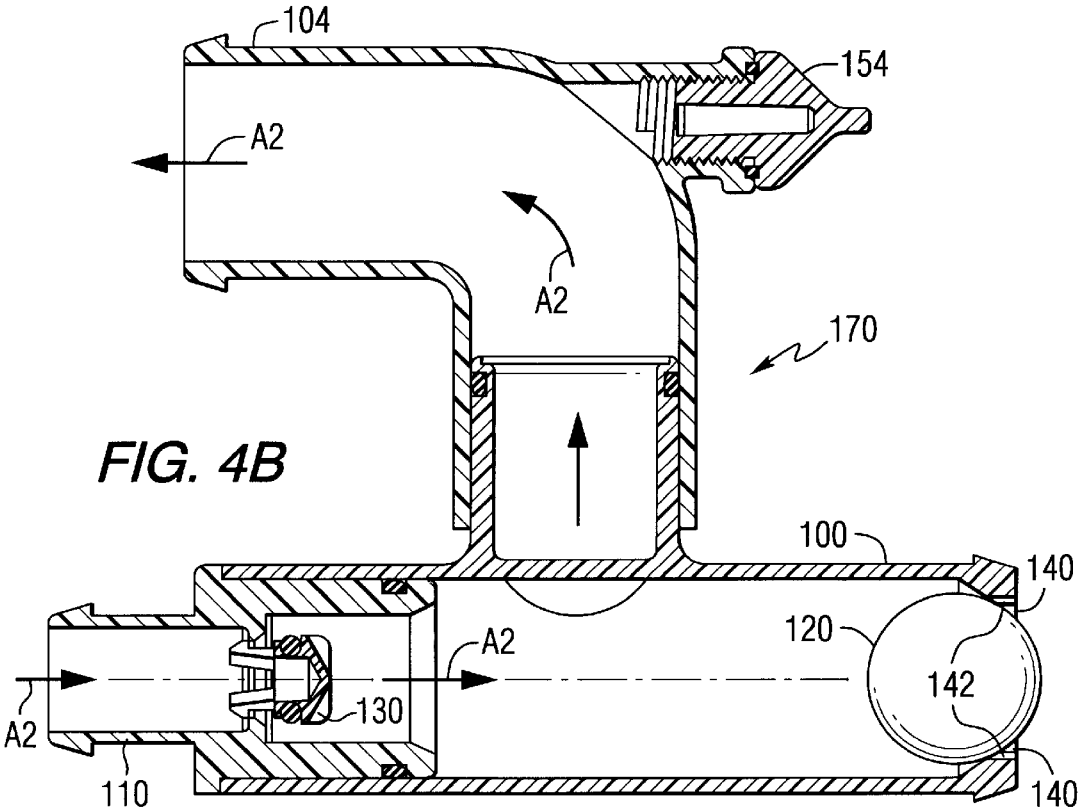

FIG. 4B shows the internal configuration of the valve 170 during a flushing procedure. The water flows along the second fluid path A2 from the second inlet 110 to the outlet 104. The pressure provided by this flow of water along the second fluid path forces the ball 120 against the ball seat 142 to block the first inlet 100. As mentioned above, the first inlet can be provided with a bypass conduit 140 in the form of one or move small grooves shaped into the first inlet 100. The fresh water is introduced into the second inlet 110 and flows through the flush valve 170 to the internal combustion engine where it cleans the internal surfaces of the engine to remove any residue or debris that may have been deposited within the engine cooling system.

Figure 5:
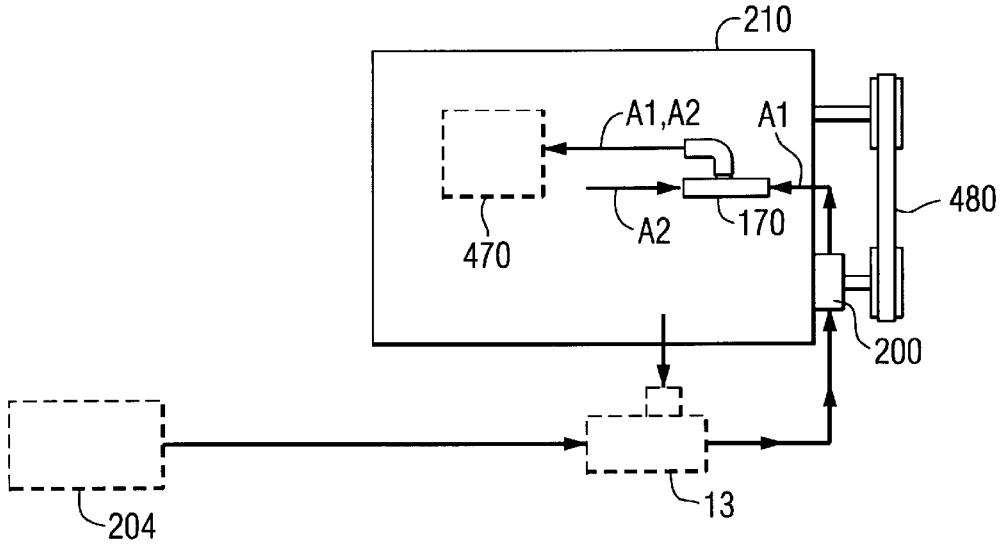
FIG. 5 is a schematic representation of an engine with the present invention shown connected between the sea water pump and the cooling system of the engine.

FIG. 5 is a highly schematic representation of an engine 210 of a marine propulsion system showing the intended location of the valve 170. FIG. 5 also shows the location, represented by dashed line, of the flushing pump 13 described above in conjunction with FIG. 1. The known flushing pump 13, described above in conjunction with FIG. 1, is typically connected between the sea water pump 200 and the body of water 204 in which the marine propulsion system is operated. The flush valve 170 of the present invention, on the other hand, is typically connected between the sea water pump 200 and the cooling system 470 of an internal combustion engine 210. The sea water pump 200 can be driven by a belt 480 in a manner generally known to those skilled in the art. Also shown in FIG. 5 are the first and second fluid paths, A1 and A2, represented by arrows.

Figure 6:
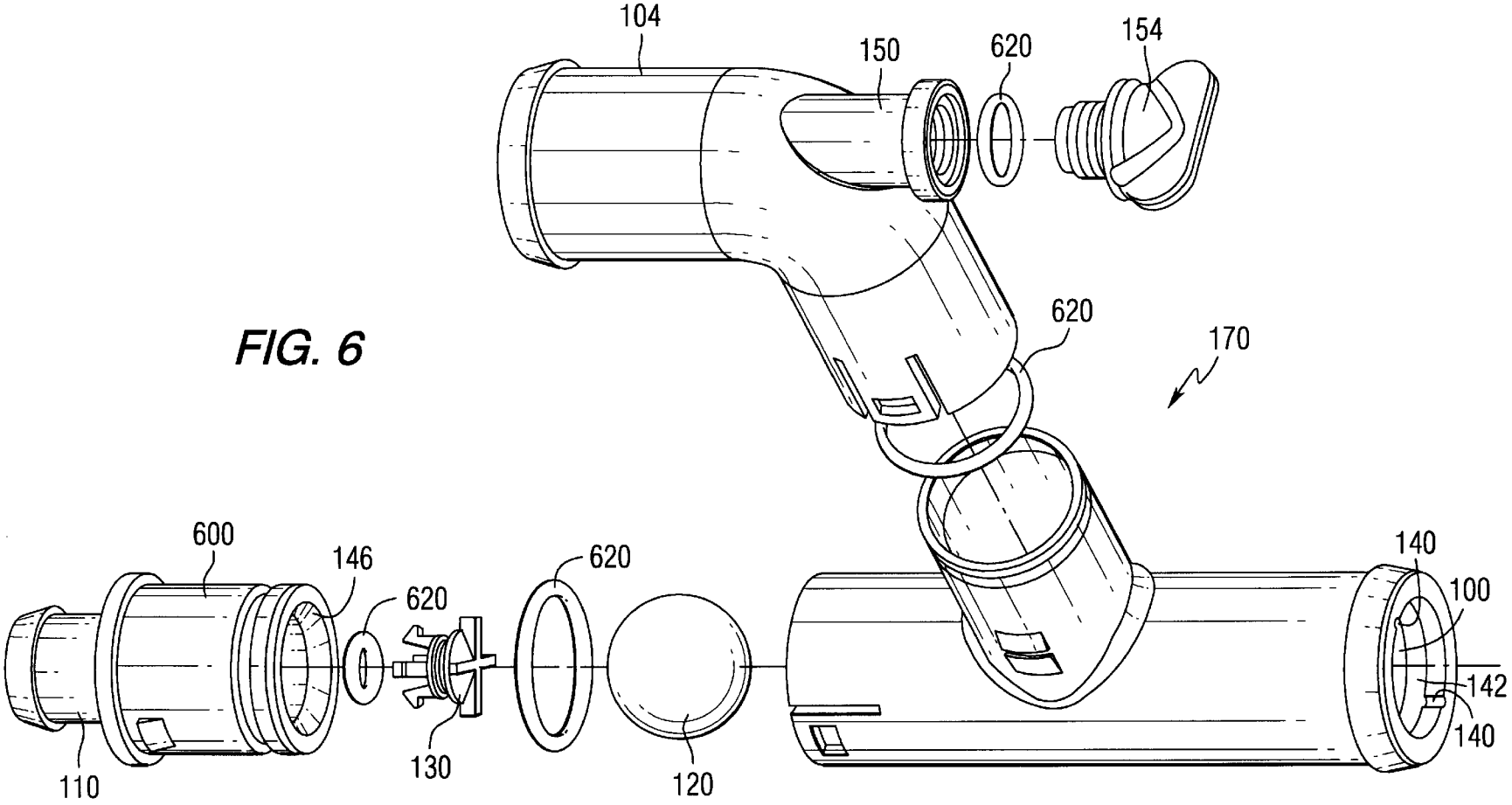
FIG. 6 is an exploded view of the present invention.

FIG. 6 is an exploded view of the valve 170 of the present invention. As can be seen, the valve 170 is made of several relatively simple components which are easily assembled together. The ball 120 is placed within the internal opening of the conduit which forms the first inlet 100. An insert 600 is then placed into the conduit to define the second inlet 110. The insert 600 comprises the ball seat 146 and contains the ball 120 within the housing structure of the valve 170. Various O-rings 620 are used to prevent leakage. The bypass conduit is provided in the embodiment shown in FIG. 6 by the grooves 140 formed in the ball seat 142 at the first inlet 100.

The structure of the valve 170 shown in FIG. 6 illustrates its simplicity and its relatively few internal components. The ball 120 is the only moving part of the valve 170 and it does not require the use of a spring to hold it into a preferred position. Instead, the water pressures provided by the first and second fluid paths cause the ball 120 to move into its desired position to perform the intended sealing function, whether it is against ball seat 146 or ball seat 142. The ball 120 provides the function of sealing the respective ball seats and causing the fluid to flow along a desired path. In certain embodiments of the present invention, the stationary sealing device 130 is also provided, but it should be understood that this is not necessary in all embodiments of the present invention.

The present invention provides a relatively inexpensive flush valve, in comparison to known types of flushing systems, and also decreases the likelihood that debris will jam the internal operation of the valve 170. In one particular embodiment of the present invention, the ball 120 is 1.00 inch in diameter while the internal diameter of the conduit which defines the inlet 100 is approximately 1.187 inches in diameter. These dimensions provide a significant clearance around the outer surface of the ball 120 to allow debris to pass around the ball and through the outlet 104. In a particularly preferred embodiment of the present invention, the ball 120 is made of delrin and is precision ground to a diameter of one inch, plus or minus two one thousands of an inch. However, it should be understood that the dimensions used in one particularly preferred embodiment of the present invention are not limiting. The present invention should be used without the engine running and can be connected in the cooling system at various locations.

Although the present invention has been described with particular specificity and illustrated to show one preferred embodiment of the present invention, it should be understood that other embodiments are also within its scope.

I claim:

1. A flush valve, comprising:

a first inlet;

a second inlet;

an outlet;

a housing structure defining a first fluid path connecting said first inlet in fluid communication with said outlet and a second fluid path connecting said second inlet in fluid communication with said outlet; and a movable sealing device, said movable sealing device being responsive to flow of a fluid along said first fluid path to block said second fluid path, said movable sealing device being responsive to flow of a fluid along said second fluid path to block said first fluid path, said movable sealing device being impermeable.

2. The flush valve of claim 1, further comprising:

a stationary sealing device disposed within said second fluid path which allows fluid flow from said second inlet to said outlet but which inhibits fluid flow from said first inlet to said second inlet.

3. The flush valve of claim 1, further comprising:

a bypass conduit associated with said first inlet, said bypass conduit allowing a reduced flow of fluid from said second inlet to pass through said first inlet when said movable sealing device is blocking said first inlet.

4. The flush valve of claim 1, further comprising:

a drain opening formed in said housing structure for draining fluid from said housing structure.

5. A flush valve, comprising:

a first inlet;

a second inlet;

an outlet which is connectable in fluid communication with a cooling system of an internal combustion engine of a marine propulsion system;

a housing structure defining a first fluid path connecting said first inlet in fluid communication with said outlet and a second fluid path connecting said second inlet in fluid communication with said outlet; and a movable sealing device, said movable sealing device being responsive to flow of a fluid along said first fluid path to block said second fluid path, said movable sealing device being responsive to flow of a fluid along said second fluid path to block said first fluid path, said movable sealing device being an impermeable ball which is movable into blocking relation with said second inlet in response to flow of a fluid along said first fluid path, said first and second inlets being aligned with each other to define a linear path along which said impermeable ball can travel between said first and second inlets.

6. The flush valve of claim 5, further comprising:

a stationary sealing device disposed within said second fluid path which allows fluid flow from said second inlet to said outlet but which inhibits fluid flow from said first inlet to said second inlet.

7. The flush valve of claim 6, further comprising:

a bypass conduit associated with said first inlet, said bypass conduit allowing a reduced flow of fluid from said second inlet to pass through said first inlet when said movable sealing device is blocking said first inlet.

8. The flush valve of claim 7, further comprising:

a drain opening formed in said housing structure for draining fluid from said housing structure.

9. A flush valve, comprising:

a first inlet;

a second inlet;

an outlet;

a housing structure defining a first fluid path connecting said first inlet in fluid communication with said outlet and a second fluid path connecting said second inlet in fluid communication with said outlet;

an impermeable movable sealing device, said impermeable movable sealing device being responsive to flow of a fluid along said first fluid path to block said second fluid path, said impermeable movable sealing device being responsive to flow of a fluid along said second fluid path to block said first fluid path, said impermeable movable sealing device being a ball which is movable into blocking relation with said second inlet in response to flow of a fluid along said first fluid path, said ball being movable into blocking relation with said first inlet in response to flow of a fluid along said second fluid path; and a stationary sealing device disposed within said second fluid path which allows fluid flow from said second inlet to said outlet but which inhibits fluid flow from said first inlet to said second inlet.

10. The flush valve of claim 9, further comprising:

a bypass conduit associated with said first inlet, said bypass conduit allowing a reduced flow of fluid from said second inlet to pass through said first inlet when said movable sealing device is blocking said first inlet.

11. The flush valve of claim 10, further comprising:

a drain opening formed in said housing structure for draining fluid from said housing structure.

* * * * *